US007823282B2

(12) United States Patent
Heinzel et al.

(10) Patent No.: US 7,823,282 B2
(45) Date of Patent: Nov. 2, 2010

(54) METHOD FOR CONNECTING AT LEAST ONE WIRE TO A CONTACT ELEMENT

(75) Inventors: Andre Heinzel, Ludwigshafen (DE); Andreas Hojenski, Oberhausen-Rheinhausen (DE)

(73) Assignee: Friatec Aktiengesellschaft (DE)

( * ) Notice: Subject to any disclaimer, the term of this patent is extended or adjusted under 35 U.S.C. 154(b) by 405 days.

(21) Appl. No.: 11/631,591

(22) PCT Filed: Jun. 24, 2005

(86) PCT No.: PCT/DE2005/001126

§ 371 (c)(1),
(2), (4) Date: Jan. 11, 2008

(87) PCT Pub. No.: WO2006/005291

PCT Pub. Date: Jan. 19, 2006

(65) Prior Publication Data

US 2008/0155823 A1 Jul. 3, 2008

(30) Foreign Application Priority Data

Jul. 7, 2004 (DE) ..... 10 2004 032 740

(51) Int. Cl.
*H01R 43/04* (2006.01)

(52) U.S. Cl. ..... 29/867

(58) Field of Classification Search ..... 29/857, 29/860, 863, 842, 876, 877, 867
See application file for complete search history.

(56) References Cited

U.S. PATENT DOCUMENTS

| | | | | |
|---|---|---|---|---|
| 3,093,887 | A | 6/1963 | Prestige et al. | |
| 5,269,713 | A | 12/1993 | Brezovar et al. | |
| 5,674,588 | A | 10/1997 | Porfido et al. | |
| 6,064,026 | A | 5/2000 | Tkazyik et al. | |
| 6,125,533 | A * | 10/2000 | Warner et al. | 29/868 |
| 6,643,926 | B2 * | 11/2003 | Sakaguchi et al. | 29/863 |

FOREIGN PATENT DOCUMENTS

CH 612 489 A5 7/1979

OTHER PUBLICATIONS

International Search Report dated Oct. 7, 2005.

* cited by examiner

*Primary Examiner*—Derris H Banks
*Assistant Examiner*—Jeffrey Carley
(74) *Attorney, Agent, or Firm*—Paul, Hastings, Janofsky & Walker LLP

(57) ABSTRACT

A method for connecting at least one wire to a contact element to facilitate connection of the wire to a power source comprising the following steps: a) preparation of the contact element which is fitted with a groove for receiving at least one wire; b) insertion of the wire into the groove of the contact element; c) lowering an electrode onto the contact element; and d) heating of the area around the groove by means of the electrode while simultaneously deforming the area around the groove thereby embedding the wire lying in said groove.

15 Claims, 6 Drawing Sheets

METHOD FOR CONNECTING AT LEAST ONE WIRE TO A CONTACT ELEMENT

BACKGROUND

1. Field of the Invention

The invention relates generally to connecting a wire to a contact element and, more particularly, to a method for connecting at least one wire to a contact element to facilitate connection of the wire to a power source comprising the steps of preparing a contact element which is fitted with a groove for receiving the wire, whereby the groove preferably is deeper than the diameter of the wire, and whereby at least one wire is inserted into the groove of the contact element.

2. Background of the Invention

Such a connection method is described in U.S. Pat. No. 5,674,588 which describes a method by which a contact element, namely a forked contact plug, is inserted into a welding sleeve to embed a wire. To achieve good electric contact it is essential that the width of the groove formed between the forked legs is smaller than the diameter of the wire to ensure good cold connection. However, this also means that the cross-sectional area of the wire changes or becomes smaller, which restricts electricity flow through the wire.

A similar method is described in U.S. Pat. No. 5,269,713. Two manual steps are necessary to connect the wire to the contact element. Firstly, a rivet head is deformed with relatively great effort by means of mechanical cold working into the desired shape. A special version of wobble technique is used for this that rotates and/or eccentrically moves the riveting hammer head which causes both facing surfaces of the riveting head to be clinched into, among other places, the groove, which in turn captures the wire in said groove. The rotating movements achieve a sideward movement towards the wire which is advantageous to achieving good contact. However, with this method, the wire is exposed to such significant force that it could deform. The flattening associated with this method deforms and reduces the size of the relatively small contact surface area of the wire cross-sectional area. In the second step, the flat electrode is placed on the flat or slightly rounded rivet head. Naturally, it is advantageous if the shape of both the rivet head and the electrode is flat, since the flatter the rivet head is, the larger the contact surface is between the electrode and the rivet head which benefits the subsequent transfer of high flows of current. Possible positioning inaccuracies between the electrode and the contact surface can also be better compensated for. The flow of current induced by resistance welding generates heat which could cause the wire lacquering to melt and evaporate. However, since the wire is completely sealed prior to the welding process, complete softening of the lacquer steam is prevented which could cause entrapments in the border area between wire and rivet head.

U.S. Pat. No. 3,093,887 discloses a method for securing a part onto a plate. Rivets fitted with a structured cladding with, for example, a grooved surface are used. In the head of said cladding is a slit for receiving a wire.

U.S. Pat. No. 6,064,026 discloses a wire inserted into a fork-shaped receiver whereby the fork pegs subsequently are pressed together to catch the wire and to penetrate any possible insulation material. A flow of current is introduced to the fork pegs by means of a welding electrode to produce an electric connection while the wire cross-section contour is deformed. The wire is not embedded.

CH 612 489 discloses a welding sleeve made from thermoplastic material that can be used employing heating coil welding techniques.

The object of the invention is a method for connecting a wire to a contact element that ensures improved high and low current stability in the generated surface junctions to the wire.

It is a further object of the invention to provide a method for connecting a wire to a contact element that preserves the cross-sectional area of the wire but that remains fully automatic.

BRIEF SUMMARY OF THE INVENTION

In accordance with the invention, as the wire is inserted into the groove of the contact element, an electrode is lowered onto the contact element to heat the area around the groove. Simultaneously, the area around the groove is deformed mechanically, embedding the wire in the groove. The method, which is a variation of hot pressure welding, facilitates the generation of an electric contact between materials that cannot be welded together. Both lacquered and non-lacquered wires can be treated. A lacquered wire means a single- or multi-layered sleeve-shaped conductor with at least one non-conducting layer. Correspondingly, a non-lacquered wire consists of a single- or multi-layered conducting material wherein at least the outer layer is a conductor. The cross-section of the wire is not necessarily circular and may be, for example, rectangular, if a flat cable is to be embedded.

In a preferred embodiment of the method a point contact, line contact or minimal surface contact is formed between the contact element and the electrode when the electrode is lowered onto the contact element. In this manner, the mechanical and electric influences on the electrode specific to the method are reduced and the operational life of the electrode is improved.

It is preferable to cool the deformed contact element subsequent to the deformation of the area surrounding the groove and the wire embedding.

Preferably, the groove is deeper than the diameter of the wire, although this is not necessary for the implementation of the method in accordance with the invention. However, it is preferable to ensure that the wire does not remain in permanent contact with the electrode. A lacquered wire, in particular, would contaminate the electrode and reduce operational life. It suffices if only half the wire lies in the groove since a particular electrode design, which will be described in further detail below, will move material from the contact element and push it over the wire.

In a particular application, two or more wires or wire ends could be placed in the groove to form an electric contact between the wires or wire ends in the groove. In this manner, it is possible to generate an electric connection between materials that are infusible or cannot be soldered.

The contact element can be configured depending on what is needed. The groove could, for example, have a rectangular, semi-circular or V-shaped cross-section, with a smooth, scalloped or corrugated inner surface. Furthermore, the groove can be shaped as a convex or be linear in longitudinal direction running either horizontally, slanted, or concave.

The contact element can consist of one single material or could consist of a coated metallic base body. The metallic base body could consist of, for example, copper, aluminum or steel that, at least partially, is coated with a low melting point metallic or conductive material. Suitable coatings for copper or aluminum are, for example, zinc or tin. A suitable coating for steel is copper. Alloys of these metals may also be employed, including a eutectic composition of these alloys, which improves the transition response of the wire to be embedded. It is possible to employ several coatings of such materials.

In a preferred embodiment the groove is formed by at least one pair of two opposite facing fork studs.

The fork studs of a pair could be placed essentially parallel to each other. However, it is also possible that the fork studs of a pair are arranged at an angle to each other to form a V-shape like groove.

The contact element can also be characterized by a plug-shaped body at one exposed end of which the groove is formed. Such a plug-shaped body is particularly suitable for insertion into the passage entrance of a carrier body.

To ensure secure fastening, a flange that consists of at least one piece is placed circumferentially around the plug body, such as a ring flange, a flange with a polygonal perimeter, or a segmented flange whereby the shape corresponds to the corresponding receiving area of the passage opening.

An electrode, which can be used for the implementation of the method in accordance with the invention, is characterized by a concavity to facilitate attachment to the contact element. Here "concavity" not only means a hemispheric shape but also a cylindrical, cone-like, polygonal or flat ring shape. This shape ensures that the desired point contact, line contact or minimal surface contact to the contact element can be formed. It is also appropriate to choose a shape that would have a certain centering or positional effect on the electrode as it is placed on the contact element.

After the welding, the inverse contour of the electrode is formed on the surface of the contact plug. This fact can be taken advantage of by structuring the inner surface of the electrode so as to impart a characteristic shape to the tulip-shape that forms after the welding. The method according to the invention requires no mechanical finishing to change the shape of the contact element surface, which finishing would not have any effect on the quality of the connection.

It is not necessary that the electrode is concave for the implementation of the method according to the invention. If the contact element is appropriately pre-shaped it is also possible to work with flat electrodes.

The above described carrier body made of thermoplastic synthetic material fitted with at least one passage opening that can receive a contact element may be a welding body, such as a sleeve, a bracket, a restricted fitting, T-piece or saddle. When using heating coil welding techniques carrier bodies should preferably be made from thermoplastic synthetic material. The material used for the carrier bodies could be partly or completely thermoplastic. Partly thermoplastic materials include, for example, composite materials that contain reinforcements, such as glass fibers, aramid fibers, or pigments. Suitable thermoplastic materials include polyethylene, polypropylene, or polyamide.

Due to its shape, the contact element is held firmly in place in the passage opening but during the electric and mechanical connection process it may be useful to support the contact plug on the opposite side of the electrode. It may be sufficient that the contact element frictional grip be pulled to the passage opening by a shoulder projecting into the passage opening. In particular embodiments, which will be described in further detail below, the contour of other parts of the bodies could also conform to the passage opening.

At least in the area of the groove on the employed contact element, it is appropriate to choose a passage opening diameter that is larger than the diameter of the contact element. In this manner, the synthetic material does not melt in the area of the groove when electric energy is introduced by means of the electrode.

BRIEF DESCRIPTION OF THE DRAWINGS

Below, the invention will be described in further detail by means of the drawings which show.

DETAILED DESCRIPTION OF THE INVENTION

The method according to the invention will be described below employing a contact plug used as a carrier body in a welding sleeve. However, this is not the only possible implementation. Other types of carrier bodies may be employed, such as brackets, restricted fittings, T-pieces, saddles and especially such welding bodies that are used in heating coil welding techniques. It is also possible to perform the contact between the contact element and the wire completely without using carrier bodies or to use non-metallic carrier bodies. Preferably, lacquered wires are used with metallic carrier bodies. It is also possible to connect the wire directly to a contact element, such as a contact plug and subsequently integrate the wire in a carrier body made of, for example, thermoplastic material. Wire ends or continuous wires may be employed. The wire can be shortened if a cutter is fitted directly onto the electrode. The wire material could be, for example, aluminum, cooper, iron, constantan, alloy wire and similar materials.

Figure 1:
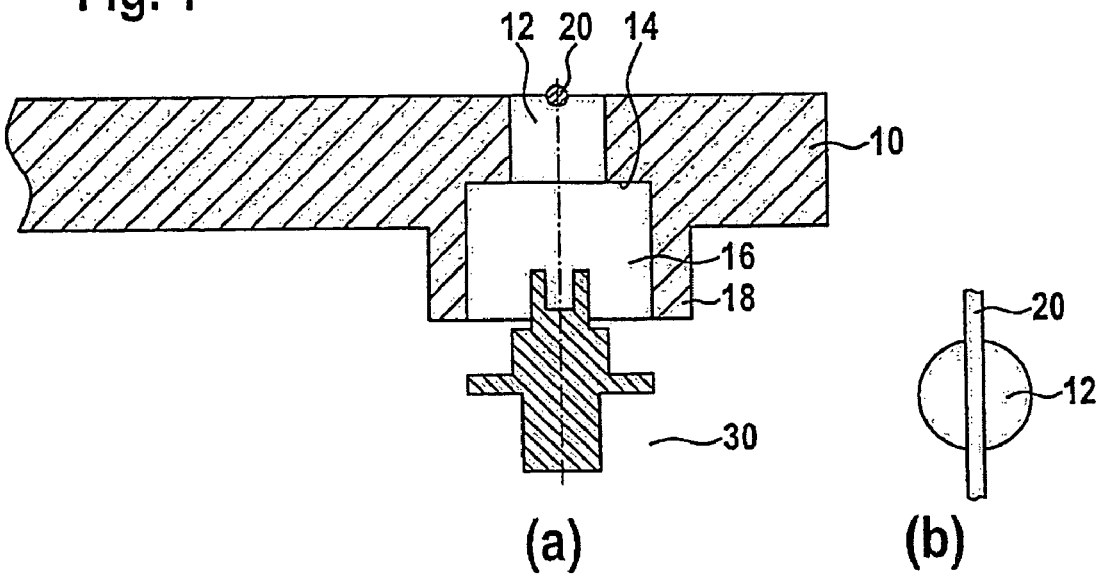
FIG. 1 a schematic partial sectional view of a welding sleeve employed as a carrier body fitted with a contact plug employed as a contact element for the implementation of the method in accordance with the invention.

FIG. 1(*a*) is a schematic partial sectional view of a welding sleeve 10, and is preferably made from a thermoplastic synthetic material, such as polypropylene or polyethylene. The welding sleeve 10 has numerous contact points that serve to attach wires 20 of which only one contact point and one wire are shown here. The wire 20 lies over a receiving channel 12 that extends to a receiving opening 16 defining a shoulder that runs in the direction of the exterior wall of the welding sleeve 10. The receiving opening 16 is limited by a ring-shaped flange 18 on the welding sleeve and here it is only partially, perhaps a quarter of it, worked into the welding sleeve 10. Other designs that do not require the flange 18 are possible. The receiving channel 12 and the receiving opening 16 form a passage opening in which, as is only indicated in FIG. 1, a contact plug 30 is inserted. In accordance with the invention, this contact plug 30 must form an electric resistance-free junction to the wire 20 and it must make the connection to a power source. As can be seen in FIG. 1, the wire 20 lies just above the interior of the welding sleeve 10 so that its position can be optically observed, for example, by a camera.

FIG. 1(*b*) shows how the wire 20 lies across the receiving channel 12. The method in accordance with the invention is so tolerant that variances from this preferred embodiment will not negatively impact the implementation of the method. The wire could, for example, also lie diagonally over the opening of the receiving channel 12 or inside the receiving channel 12, be corrugated or compressed.

It is also possible that area 36 of the body be shaped in such a way that it is aligned with the fork studs 42, 44 or that it is stepped in other ways. As is shown in FIG. 3, it is essential that there is an annulus area 38 that functions as a thermal isolator.

Figure 2:
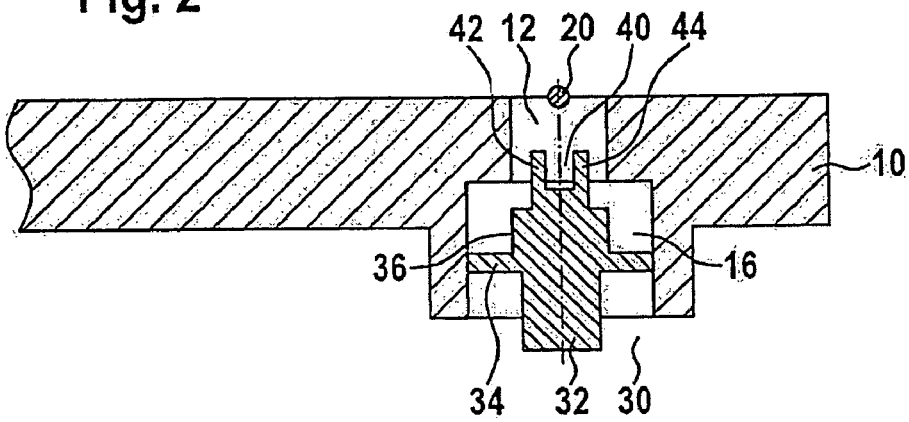
FIG. 2 a view similar to the view in FIG. 1 showing the contact plug inserted into the receiving opening.

FIG. 2 shows the contact plug 30 as its body 32 is led into the receiving opening 16 of the welding sleeve 10. The diameter of the body 32 is significantly smaller than the diameter of the receiving opening 16. However, the body 32 is fitted with a circumferential ring flange 34 that is dimensioned in such a way that the contact plug 30 still is movable but is positioned securely to prevent friction in the receiving opening 16. Above the circumferential ring flange 34, there is an area 36 on the contact plug which has a diameter that corresponds to the diameter of the receiving channel 12. This larger area 36 is fitted with two fork studs 42, 44 placed opposite each other forming a groove 40 between them into which the wire 20 will later be received.

Figure 3:
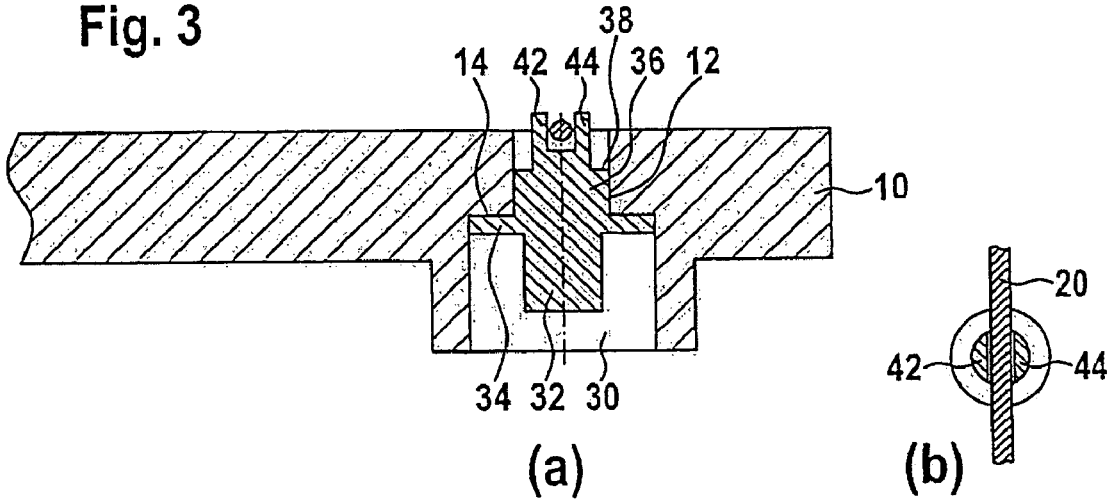
FIG. 3 a view similar to the view in FIG. 2 showing the contact plug in its final position in the welding sleeve.

FIG. 3(*a*) shows the final position of the contact plug 30 in the welding sleeve 10. The circumferential ring flange 34 on the body 32 of the contact plug 30, which is shown closed here but also could be segmented, lies on the shoulder 14 of the receiving opening 16. The larger area 36 above the circumferential ring flange 34 fits snugly into the receiving channel 12 and takes up approximately half of its height. In the transition area to the fork studs, there is a step 38 that allows the fork studs 42, 44 to keep a certain distance from the welding sleeve 10 that surrounds it whereby the annulus area 38 that is thus formed will later protect the surrounding synthetic material of the welding sleeve 10 against undesirable thermal damage during the welding process. The fork studs 42, 44 extend above the inner surface of the welding sleeve 10 thereby forming a positioning aid which will be described in further detail in the discussion of FIG. 5. Other implementations are possible where the fork studs 42, 44 are more or less inside the receiving channel 12. The exact design depends on the desired position of the wire 20 in relation to the welding sleeve 10 or the contact plug 30.

FIG. 3(*b*) shows how the wire 20 lies loosely between the fork studs 42, 44. It is neither necessary nor desirable to embed the wire 20 to implement the method according to the invention. Positioning the wire 20 loosely ensures that the wire cross-section contour is maintained after contact. In this manner, an ideal low and high current stability is achieved in the surface junctions generated between wire and contact plug or from contact with the method according to the invention.

Figure 4:
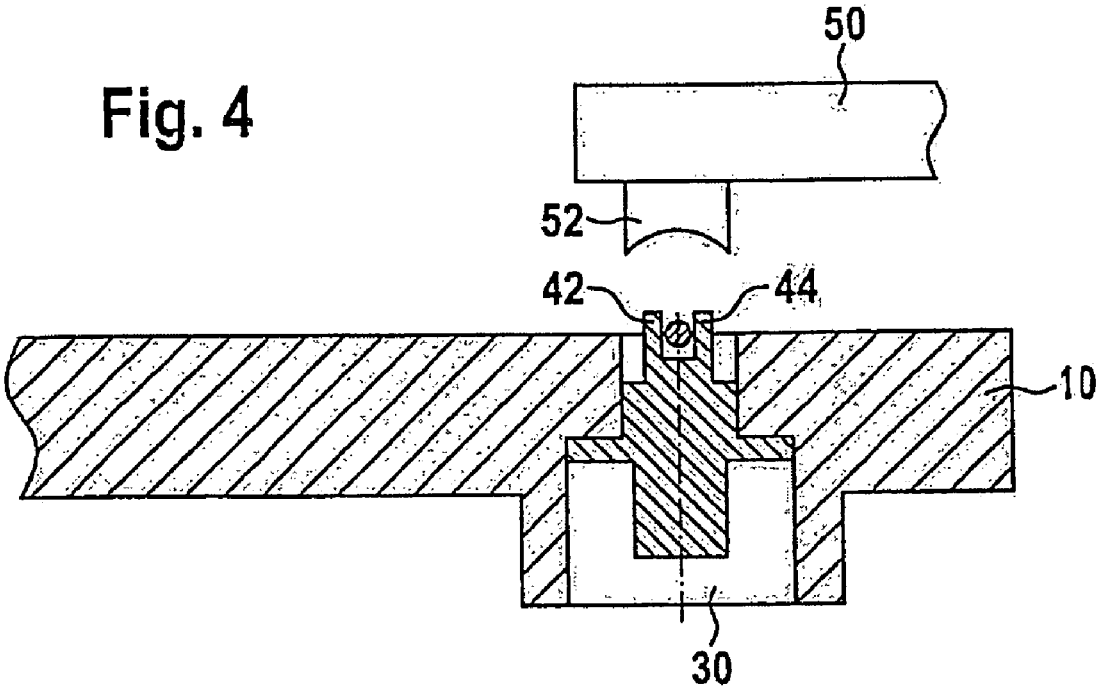
FIG. 4 a view of the welding sleeve with a contact plug and approaching electrode.
Figure 5:
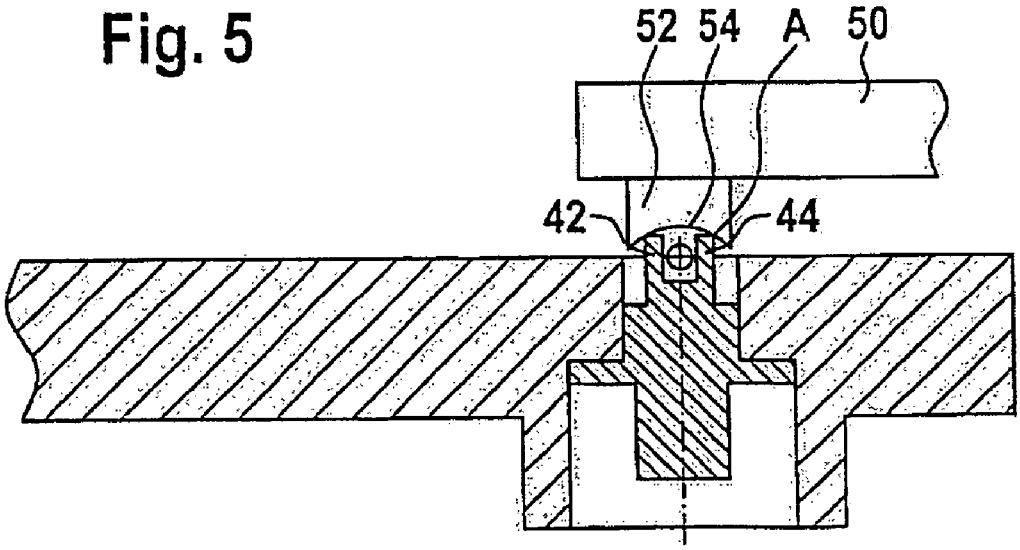
FIG. 5 a view of the electrode lying on the contact plug.
Figure 6:
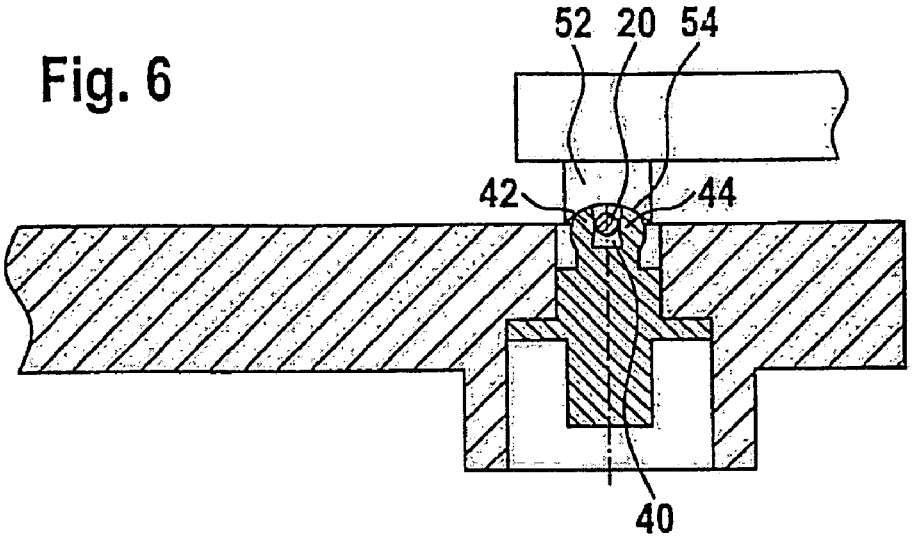
FIG. 6 a view which illustrates the hot pressure welding process.
Figure 7:
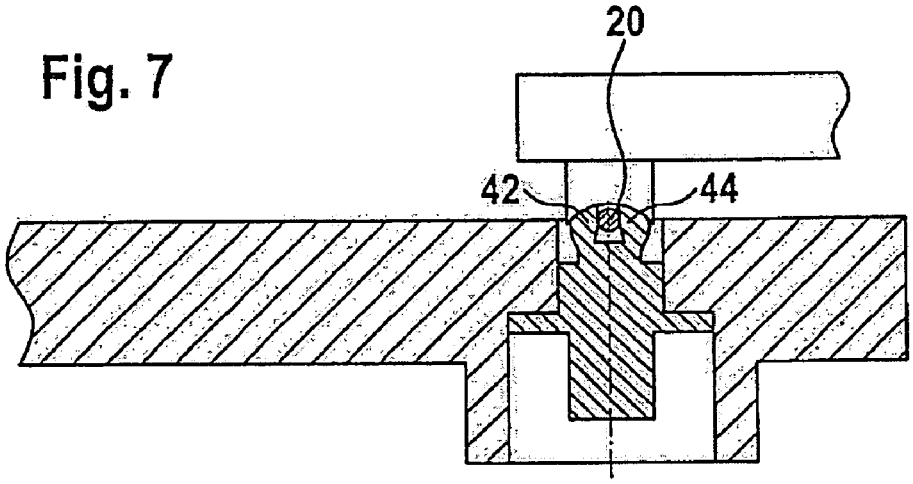
FIG. 7 a view similar to the view in FIG. 6 showing the advancing hot pressure welding process.
Figure 8:
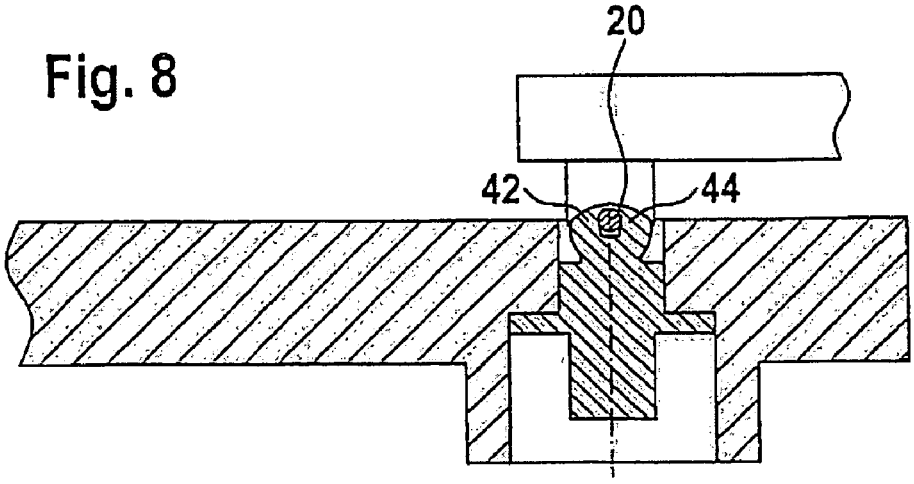
FIG. 8 a view similar to the view in FIG. 7 showing the stage when the hot pressure welding process is almost completed.
Figure 9:
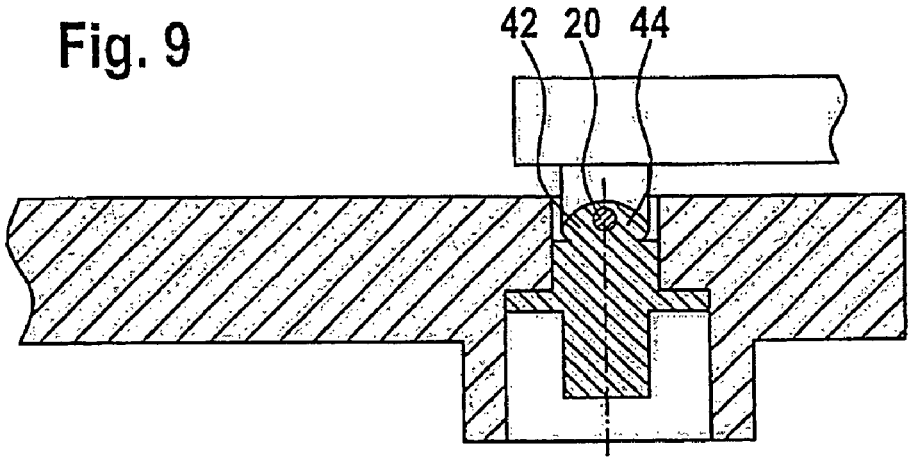
FIG. 9 a view similar to the view in FIG. 8 with an embedded wire.

FIG. 4 shows how an electrode 52 which is attached to a holding device 50 lies above the end of the contact plug 30 that is protruding from inside the welding sleeve 10 in such a way that it is aligned with the fork studs. Finally, as is shown in FIG. 5, the holding device 50 by means of the electrode 52 is lowered until the concave inner surface 54 lies on the fork studs 42, 44 forming a line contact which is schematically shown and denoted with the letter A. Here, line contact means a narrow border area that is formed between the electrode 52 and the fork studs 42, 44 which allows such higher currents to flow that the temperature level of the fork studs 42, 44 rises due to the mechanical and/or electrically generated energy. This reduces the stability of the fork studs 42, 44, making them soft and could deform them. This can be better seen in FIG. 6. At least one point contact is necessary to generate a flow of current while several point contacts would be better and ideally the above described line or surface contact should be formed whereby the method specific mechanical and electric influence on the electrode is reduced and its operational life increased. The use of one or several current flows or current impulses, which is adjusted according to the choice of fork stud 42, 44 design and material, deforms the fork studs 42, 44. The designs and materials proposed in the implementation example for the contact plug 30 and wire 20 requires, at peak power of 5 kW with an effective performance of 2 kW for approximately 0.5 sec (with possible variations of +/−0.3 sec), 0.2 Wh of electric work. The fork studs 42, 44 deform whereby, due to the concave inner surface 54 of the electrode 52, a displacement of the fork stud material in the groove 40 is promoted. As the electric deformation continues, as can be seen in FIG. 7, the wire 20 is held between the fork studs 42, 44 and finally, as seen in FIG. 8, it is completely embedded by them. FIG. 9 shows the final deformation process when the wire 20 is seen with its cross-sectional area maintained between the now deformed fork studs 42, 44. The previously exposed fork stud ends 42, 44 have been welded to each other so it is practically impossible to unintentionally free the wire.

Figure 10:
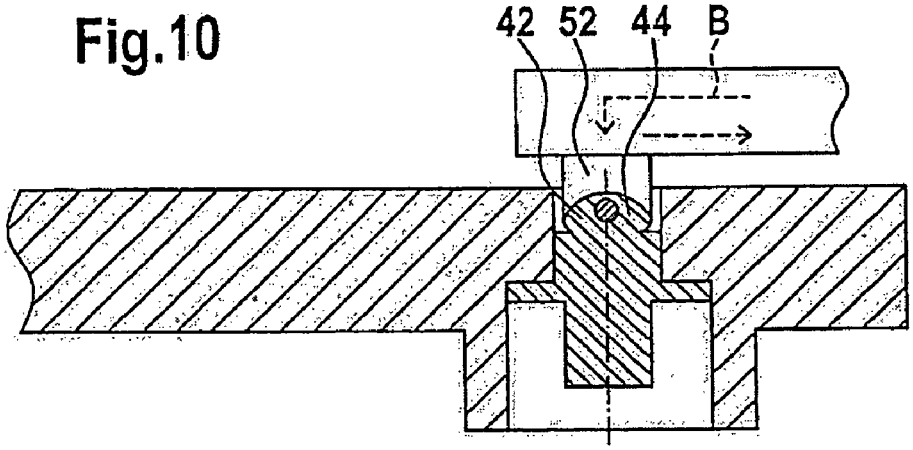
FIG. 10 a view that illustrates the cooling process.
Figure 11:
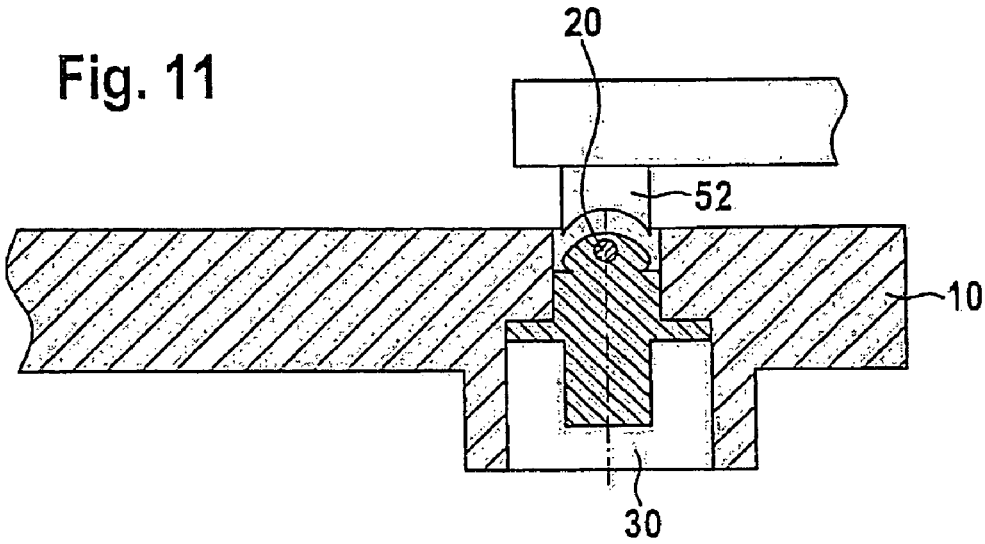
FIG. 11 a view of the exiting electrode and completely embedded wire.

Finally, in accordance with FIG. 10, an optimal cooling process is initialized, indicated by the dashed lined arrow B, and subsequently, as can be seen in FIG. 11, the electrode 52 is removed. The contact plug 30 now has a securely embedded wire 20 in the welding sleeve 10. It was shown that no measurable contact resistance occurred between the contact plug 30 and the wire 20, although the method in accordance with the invention can treat materials that cannot be welded since the contact occurs using mounting whereby the energy induced in the system and its thermal influence benefit the method described here.

Figure 12:
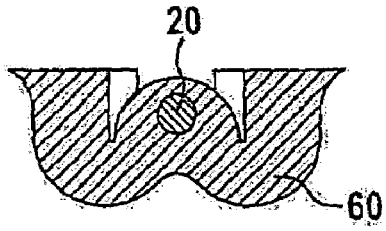
FIG. 12 a variant in which a solid body is employed.

FIG. 12 shows a variant where the wire 20 is mounted in solid material 60 which means that some of the solid material overtakes the function of the contact element which in the embodiment shown in FIGS. 1 to 11 was embodied by the contact plug 30. The wire 20 lies loosely in a corresponding groove and is then mounted with the solid material as an electrode is lowered as seen in FIG. 4.

Figure 13:
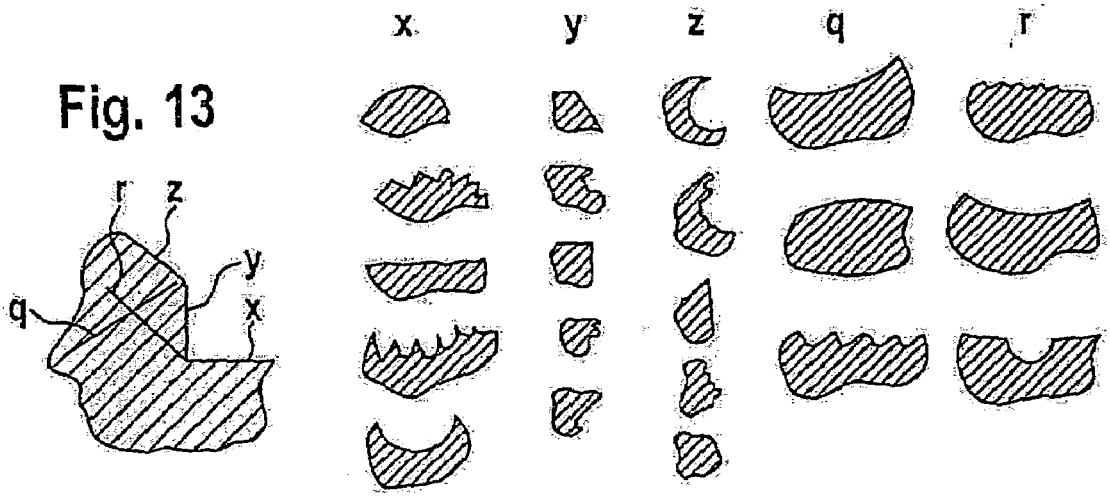
FIG. 13 a number of possible groove shapes.

FIG. 13 shows a number of possible groove 40 shapes. The floor x of the groove 40 can be convex or concave, be a straight line or scalloped or fitted with serrations. The same applies to the groove side walls y which are placed vertically to the floor x leaning outwards or inwards and which may have different surface structures. In lengthwise direction z from the groove 40 variants of designs are possible, such as the shown concave shape with and without serrations, a straight design or an irregular profile or a convex shape. Similarly, the groove radius r and the groove edge q can have a variety of different designs. The representations in the figures are merely examples.

Figure 14:
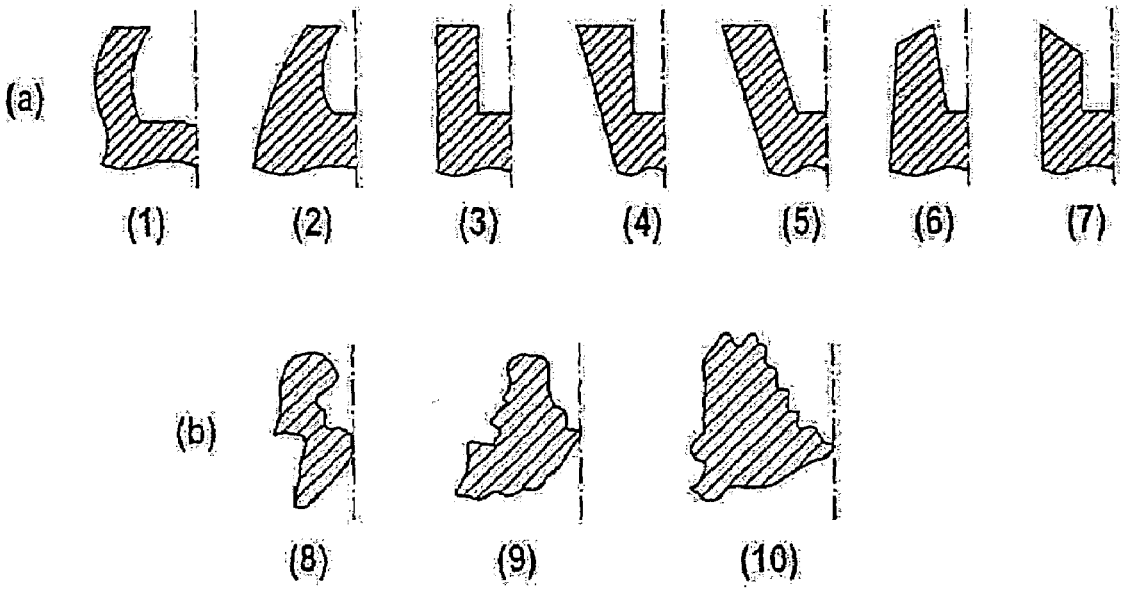
FIG. 14 variants of fork stud shapes.

Finally, FIG. 14 shows variants of possible shapes for the fork studs 42, 44. The inner surface of the fork studs—here only fork stud 42 is shown—are adapted to suit the shape of the desired groove shape 40. The exterior surface of the fork stud 42 can have a wide variety of shapes depending on the conditions of the surrounding area and on the bending behavior of the fork stud 42 material. The representations in figure (a) are cross-sectional views that show that a fork stud, for example, can have a concave cross-section or different thicknesses such as seen in FIGS. (1) and (2), it can be right-angled as shown in FIG. (3) or it can be turned away from the groove as shown in FIG. 4) or as shown in FIG. (5). The exposed end of the fork studs do not have to be horizontal but could also lean towards or away from the groove as seen in FIGS. (6) and (7). Figure (b) shows a top view of the face of the fork stud which, as can be seen in the representations in FIGS. (8), (9) and (10), can have an irregular contour.

Figure 15:
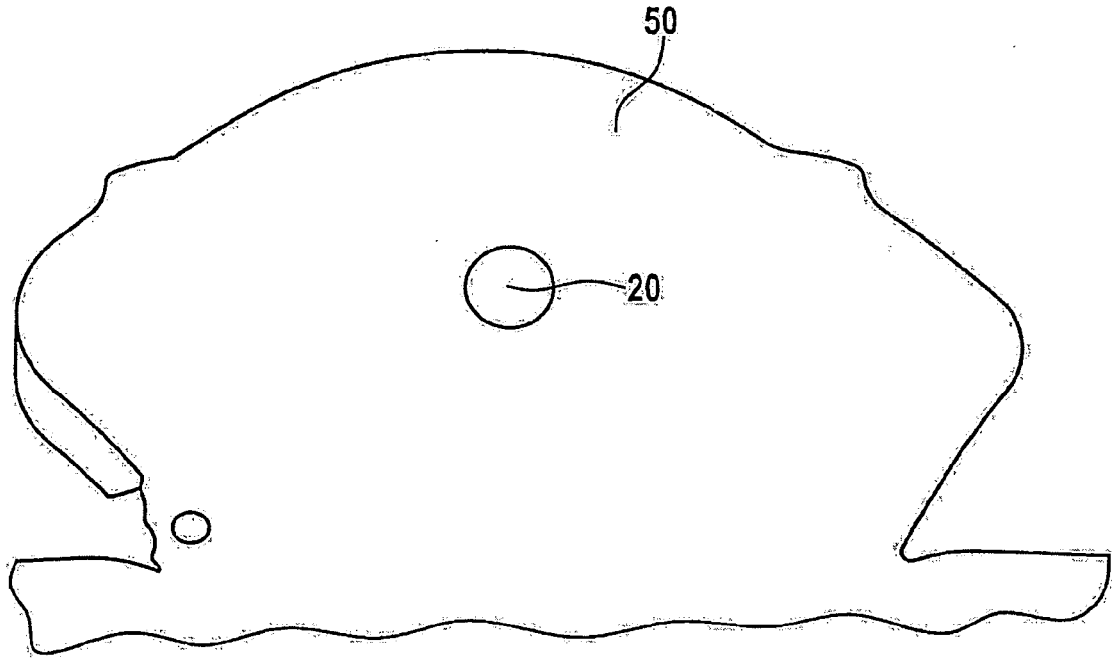
FIG. 15 a grinding pattern of a contact point manufactured with the method according to the invention.

Combinations of all the described shapes are possible. FIG. 15 shows a grinding pattern of a contact point manufactured with the method in accordance with the invention. The fork studs of the contact point are shaped like a tulip due to the mechanical and electric deformation which has embedded the wire 20.

The characteristics of the invention revealed in the above description, in the drawings, as well as in the claims could be significant for the realization of the invention individually as well as in any combination.

What is claimed is:

1. A method for connecting at least one wire to a contact element for connecting the wire to a power source, comprising the steps of:

(a) providing a contact element having a groove for receiving at least one wire, said groove having two fork studs, one on either side of the groove;

(b) placing the wire in the groove of the contact element;

(c) lowering an electrode onto the contact element to establish two line contacts between the contact element and the electrode, one line contact on each of the two fork studs;

(d) heating the fork studs on either side of the groove by flowing current through the electrode and through the fork studs, wherein only the fork studs have been reduced in strength by being heated, and wherein the fork studs are mechanically deformed, so that the wire lying in the groove is pressed into electrical contact with the contact element and is completely enclosed by the deformed fork studs which become welded to each other while its cross-section remains essentially intact.

2. The method according to claim 1, further comprising after step (d):

e) cooling the deformed contact element.

3. The method according to claim 1, wherein the groove is deeper than the diameter of the wire.

4. The method according to claim 1, wherein two or more wires or wire ends are placed in the groove to establish an electric contact between the wires or wire ends.

5. The method according to claim 1, wherein the groove has a rectangular, semi-circular, or V-shaped cross-section.

6. The method according to claim 5, wherein the inner surfaces of the groove are smooth, scalloped, corrugated, or fitted with serrations.

7. The method according to claim 5, wherein the groove is convex or linear in a longitudinal direction and is either horizontal, slanted, or concave in a transverse direction.

8. The method according to claim 1, wherein the fork studs of a pair are essentially parallel to each other.

9. The method according to claim 1, wherein the fork studs are at an angle to each other.

10. The method according to claim 5, wherein the contact element comprises a plug-shaped body, at a free end of which the groove is formed.

11. The method according to claim 10, wherein a flange is fitted circumferentially around the plug-shaped body, said flange comprising one or more parts.

12. The method according to claim 1, wherein the contact element comprises a base body that is at least partially coated with a metallic coating that has a low melting point or improved electric conductivity or both a low melting point and improved electric conductivity.

13. The method of claim 1, wherein the electrode has a concave surface for resting on the contact element.

14. The method according to claim 12, wherein the metallic coating is one of zinc, tin, copper or alloy thereof.

15. The method according to claim 14, wherein the metallic coating is a eutectic.

* * * * *